US010858898B2

(12) United States Patent
Rosenthal et al.

(10) Patent No.: US 10,858,898 B2
(45) Date of Patent: Dec. 8, 2020

(54) AUTO-BLEEDING SETTING TOOL WITH OIL SHUT-OFF VALVE AND METHOD

(71) Applicant: GEODYNAMICS, INC., Millsap, TX (US)

(72) Inventors: Wayne Rosenthal, Weatherford, TX (US); Jeremy Castaneda, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 156 days.

(21) Appl. No.: 16/026,606

(22) Filed: Jul. 3, 2018

(65) Prior Publication Data

US 2019/0323308 A1 Oct. 24, 2019

Related U.S. Application Data

(60) Provisional application No. 62/660,489, filed on Apr. 20, 2018.

(51) Int. Cl.

| | |
|---|---|
| ***E21B 23/10*** | (2006.01) |
| ***E21B 34/06*** | (2006.01) |
| ***E21B 23/04*** | (2006.01) |

(52) U.S. Cl.

CPC ..... *E21B 23/10* (2013.01); *E21B 23/04* (2013.01); *E21B 34/063* (2013.01)

(58) Field of Classification Search

CPC ..... E21B 23/00; E21B 23/10; E21B 23/04; E21B 23/042; E21B 34/063

See application file for complete search history.

(56) References Cited

U.S. PATENT DOCUMENTS

| | | | | |
|---|---|---|---|---|
| 2009/0301184 | A1 | 12/2009 | Irani et al. | |
| 2013/0020065 | A1 | 1/2013 | Tubel et al. | |
| 2015/0322747 | A1 | 11/2015 | Kasperski | |
| 2016/0047189 | A1* | 2/2016 | MacLeod | E21B 23/06 166/377 |
| 2018/0238151 | A1* | 8/2018 | Burke | E21B 43/10 |

FOREIGN PATENT DOCUMENTS

| | | | |
|---|---|---|---|
| WO | 2017007332 | A1 | 1/2017 |
| WO | 2018136808 | A1 | 7/2018 |

OTHER PUBLICATIONS

Search Report in International Application No. PCT/US2019/021794 dated May 14, 2019.

Written Opinion in International Application No. PCT/US2019/021794 dated May 14, 2019.

* cited by examiner

*Primary Examiner* — David Carroll

(74) *Attorney, Agent, or Firm* — Patent Portfolio Builders PLLC

(57) ABSTRACT

A setting tool for setting an auxiliary tool in a well, the setting tool including a housing having a floating piston, the floating piston separating the housing into a pressure chamber, located upstream the floating piston, and a hydraulic chamber located downstream the floating piston; an internal plug having an upstream end attached to the floating piston and having a downstream end extending into the hydraulic chamber; and a cover-insert member covering the downstream end of the internal plug. The internal plug has an internal passage that fluidly communicates (1) with an internal passage through the floating piston, at one end, and (2) with a port at the other end, and the port is covered by the cover-insert member.

40 Claims, 7 Drawing Sheets

AUTO-BLEEDING SETTING TOOL WITH OIL SHUT-OFF VALVE AND METHOD

BACKGROUND

Technical Field

Embodiments of the subject matter disclosed herein generally relate to downhole tools for perforating well operations, and more specifically, to an auto-bleeding setting tool used in a well for actuating various auxiliary tools. The auto-bleeding setting tool has an oil shut-off valve.

Discussion of the Background

During well exploration, various tools are lowered into the well and placed at desired positions for plugging, perforating, fracturing, or drilling the well. These tools are placed inside the well with the help of a conduit, as a wireline, electric line, continuous coiled tubing, threaded work string, etc. However, these tools need to be activated or set in place. The force needed to activate such a tool is large, for example, in excess of 15,000 lbs in some instances. Such a large force cannot be supplied by the conduit noted above.

A setting tool is commonly used in the industry to activate the tools noted above. Such a setting tool is typically activated by an explosive charge that causes a piston to be driven inside the setting tool. The movement of this piston is used for activating the various tools. A traditional setting tool 100 is shown in FIG. 1 and includes a firing head 102 that is connected to a pressure chamber 104. The firing head 102 ignites a primary igniter 103 that in turn ignites a power charge 106. Note that a secondary igniter may be located between the primary igniter and the power charge to bolster the igniting effect of the primary igniter.

A cylinder 110 is connected to a housing of the pressure chamber 104 and this cylinder fluidly communicates with the pressure chamber. Thus, when the power charge 106 burns, the large pressure generated inside the pressure chamber 104 is guided into the cylinder 110. A floating piston 112, which is located inside the cylinder 110, is pushed by the pressure formed in the pressure chamber 104 to the right in the figure. Oil 114, stored in a first chamber 115 of the cylinder 110, is pushed through a connector 116, formed in a block 118, which is located inside the cylinder 110, to a second chamber 120. Another piston 122 is located in the second chamber 120. Under the pressure exerted by the oil 114, the piston 122 and a piston rod 124 exert a large force on a crosslink 126. Crosslink 126 can move relative to the cylinder 110 and has a setting mandrel 128 for setting a desired tool (which was discussed above). Note that cylinder 110 has the end 130 sealed with a cylinder head 132 that allows the piston rod 124 to move back and forth without being affected by the wellbore/formation pressure.

After the setting tool has been activated and the additional tool has been set, the setting tool needs to be raised to the surface and be reset for another use. Because the burning of the power charge 106 has created a large pressure inside the pressure chamber 104, this pressure needs to be relieved outside the setting tool, the pressure chamber needs to be cleaned from the residual explosive and ashes, and the pistons and the oil (hydraulic fluids) need to be returned to their initial positions.

Relieving the high pressure formed in the pressure chamber 104 is not only dangerous to the health of the workers performing this task, because of the toxic gases left behind by the burning of the power charge, but is also a safety issue because the pressure in the pressure chamber is high enough to injure the workers if its release is not carefully controlled. In this regard, note that the traditional setting tool 100 has a release valve 140 that is used for releasing the pressure from inside the pressure chamber. However, when the release valve 140 is removed from cylinder 100, due to the high pressure inside the cylinder, the release valve may behave like a projectile and injure the person removing it. For this reason, a dedicated removing procedure has been put in place and also a safety sleeve is used to cover the release valve, when at the surface, for relieving the pressure from the setting tool.

However, this procedure is cumbersome, time consuming and still, if a person misses any detail of the procedure, that person can get injured by the release valve. Thus, there is a need to release the accumulated pressure inside the cylinder in a way that is quick and poses no harm to the person performing this action.

SUMMARY

According to an embodiment, there is a setting tool for setting an auxiliary tool in a well. The setting tool includes a housing having a floating piston, the floating piston separating the housing into a pressure chamber, located upstream the floating piston, and a hydraulic chamber located downstream the floating piston; an internal plug having an upstream end attached to the floating piston and having a downstream end extending into the hydraulic chamber, and a cover-insert member covering the downstream end of the internal plug. The internal plug has an internal passage that fluidly communicates (1) with an internal passage through the floating piston, at one end, and (2) with a port at the other end. The port is covered by the cover-insert member.

According to another embodiment, there is an automatically bleeding off setting tool that includes a housing; a floating piston located inside the housing; an internal plug having an upstream end located inside the floating piston and having a downstream end extending outside the floating piston, and a cover-insert member covering the downstream end of the internal plug. The internal plug has (a) an internal passage that extends only partially along the internal plug and (b) a port that fluidly communicates with the internal passage, but is closed by the cover-insert member.

According to still another embodiment, there is a method for automatically bleeding off a setting tool. The method includes a step of lowering the setting tool into a well, the setting tool having a floating piston, a step of actuating the floating piston along a longitudinal axis of a housing (202) of the setting tool, a step of engaging a cover-insert member, which is attached to the floating piston through an internal plug, to an isolation valve assembly, a step of opening an internal passage through the floating piston by moving the cover-insert member relative to the internal plug, a step of closing an isolation valve of the isolation valve assembly by moving the isolation valve relative to an insert of the isolation valve assembly, and a step of bleeding out pressurized burnt gas from the housing, into the well, through the floating piston, the internal plug, and the isolation valve.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a setting tool. However, the embodiments discussed herein are also applicable to any tool in which a high-pressure is generated and then that high-pressure needs to be released outside the tool in a safe manner.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, an auto-bleeding setting tool has a floating piston that separates the burnt gas (the one that creates the residual unwanted pressure) from the oil that is used to actuate the wellbore tool attached to the setting tool. The piston has at least one internal plug having a passage that extends from the gas side to the oil side. A cover-insert member blocks a port formed in the internal plug, before the setting tool sets the wellbore tool. The setting tool also includes an isolation oil valve that is open before the wellbore tool is set. After the wellbore tool is set, the cover-insert member unblocks the path in the piston so that the pressurized air can escape outside the setting tool while the insulation valve closes the chamber in which the oil is present and separates it from the burnt gas.

Figure 1:
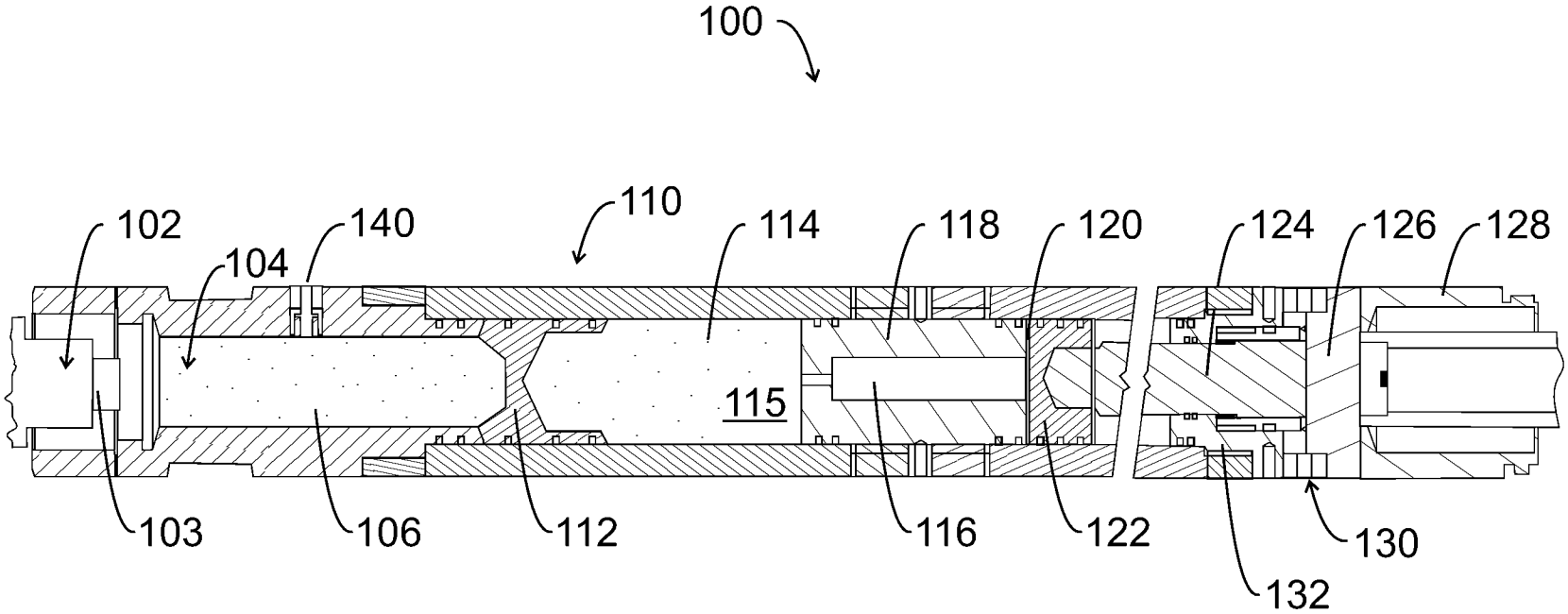
Fig. 1 (Background Art)
FIG. 1 illustrates a traditional setting tool that need, to be retrieved to the surface for relieving pressurized gas from inside.
Figure 2:
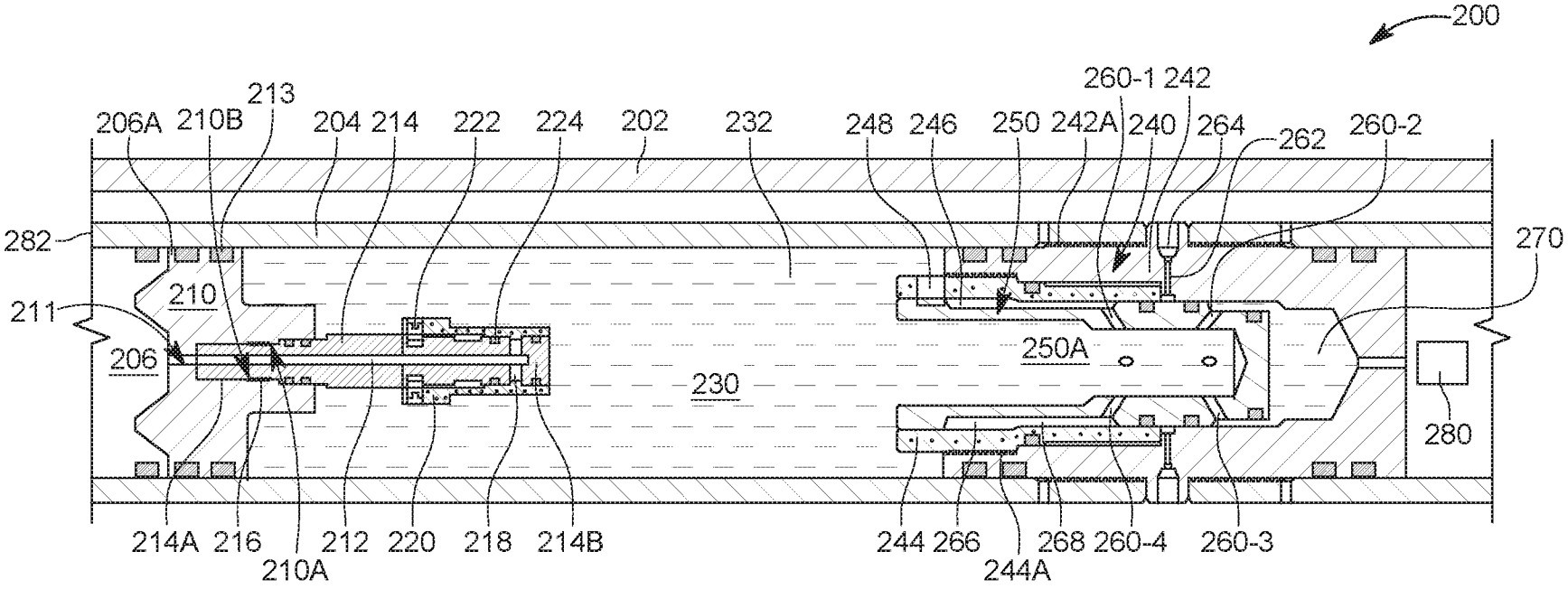
FIG. 2 illustrates a new setting tool that is configured to automatically bleed off the pressurized gas inside the well.

Thus, the auto-bleeding setting tool (simply called herein the "setting tool") automatically vents out into the well the pressurized gas after the wellbore tool has been set. More specifically, FIG. 2 shows a setting tool 200 placed inside a casing 202. Setting tool 200 has a housing 204 that hosts a pressure chamber 206. A downstream end 206A of the pressure chamber 206 (in the discussion herein, the term "downstream" is understood to indicate a direction toward the end or toe of the well, irrespective of whether the well is vertical or horizontal, and the term "upstream" is understood to indicate a direction toward the surface head of the well) is closed by a floating piston 210. Note that one or more O-rings 213 may be placed around the floating piston 210, facing the housing 204, for sealing an interface between the piston and the housing.

Floating piston 210 has a longitudinal passage 211 that allows the gas from the pressure chamber 206 to move towards a hydraulic chamber 230, which holds a given amount of oil 232 or a similar hydraulic fluid. As shown in FIG. 2, the passage 211 extends through the floating piston 210 and continues with a passage 212 that extends in a downstream direction, within an internal plug 214. The passage 212 in the internal plug 214 extends only partially along a longitudinal axis of the internal plug. In other words, the passage 212 extends from an upstream end 214A of the internal plug 214 towards a downstream end 214B of the internal plug, but does reach the downstream end 214B. The upstream end 214A of the internal plug 214 enters inside the piston 210, into a bore 210A of the piston 210. The upstream end 214A of the internal plug 214 may have a thread 216, which mates with a corresponding thread 210B of the piston 210. Thus, the internal plug 214 may be screwed into the bore of the piston 210. Those skilled into the art would understand that other means may be used for attaching the internal plug to the piston.

The downstream end 214B of the internal plug 214 includes at least one port 218 that communicates with the passage 212. Thus, the passage 212 opens at the upstream end into the pressure chamber 206 and at the downstream end into the port 218. When the setting tool is not actuated, as still shown in FIG. 2, the port or ports 218 are covered by a cover-insert member 220 so that the passage 212 cannot fluidly communicate with the hydraulic chamber 230. In other words, until the cover-insert member 220 is not moved relative to the internal plug 214, ports 218 are closed.

The cover-insert member 220 is fixedly attached to the internal plug 214 by one or more shear pins 222. In this embodiment, a pair of shear pins 222 are used. The shear pin 222 extends through the cover-insert member 220 and partially through the body of the internal port 214. One or more O-seals 224 are placed downstream and upstream from the port 218 for preventing the oil to enter the port 218 and/or for preventing the pressurized gas from the pressure chamber 206 to enter the hydraulic chamber 230. Note that the internal plug 214 extends from the piston 210 to an inside of the hydraulic chamber 230 and the cover-insert member 220 is located in its entirety inside the hydraulic chamber 230 when the setting tool is not actuated.

The other end of the hydraulic chamber 230 is closed by an isolation valve assembly 240. The isolation valve assembly 240 includes a body 242, which is attached by threads 242A to the housing 204. The body 242 has a bore in which an insert 244 is placed. Insert 244 may have threads 244A, which engage mating threads formed in the bore of the body 242. Thus, insert 244 does not move relative to the body 240. Insert 244 has its own bore 246. In this bore, an isolation valve 250 is placed. A shear pin 248 is shown in FIG. 2 mechanically connecting the isolation valve 250 to the insert 244. Thus, initially, the two components of the isolation valve assembly 240 are mechanically connected to each other and because the insert 244 is fixed to the body, none of these components move relative to the body.

Figure 3:
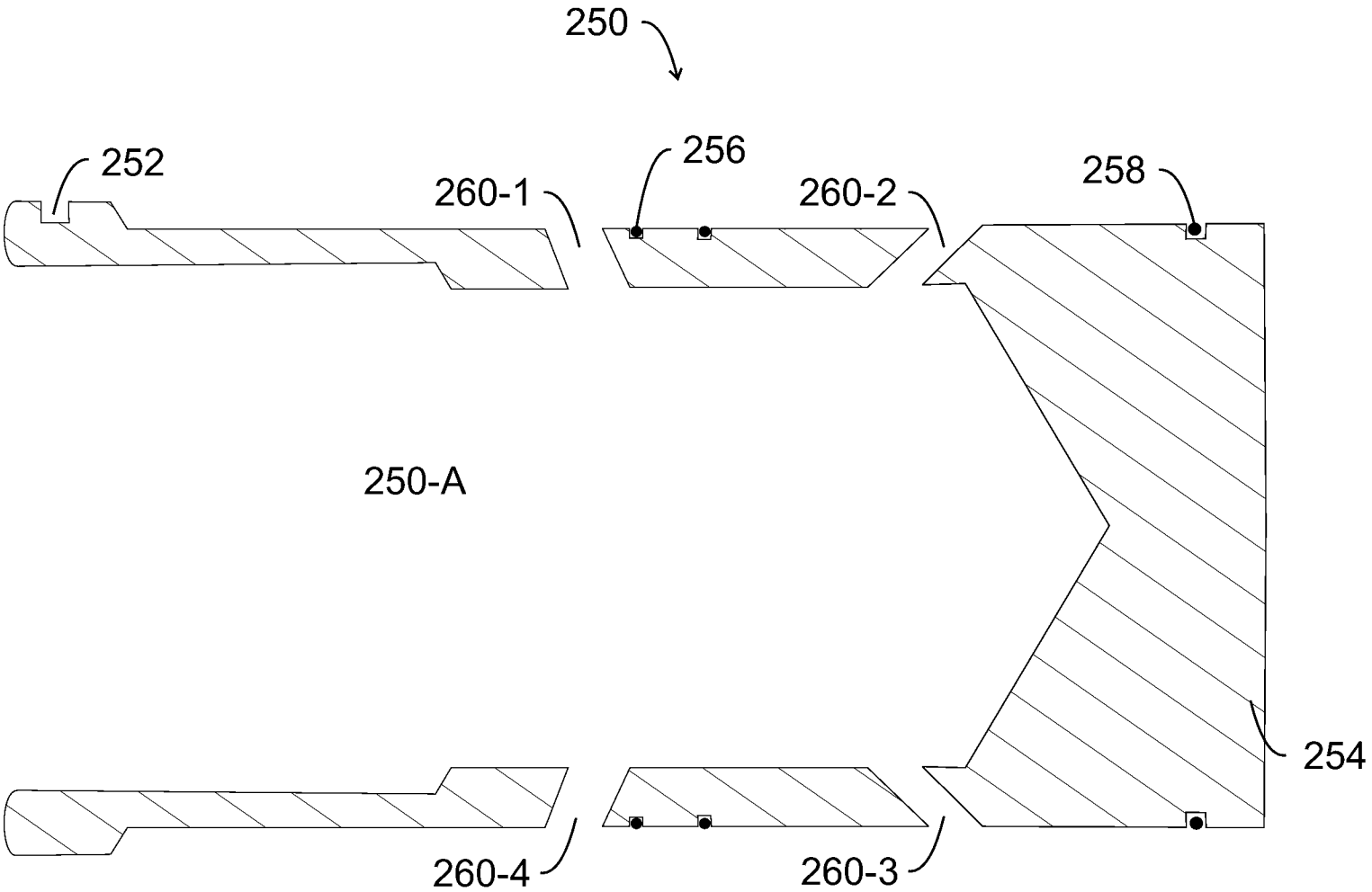
FIG. 3 illustrates an isolation valve that allows the pressurized gas to automatically leave the setting tool.

The isolation valve 250 is shown in FIG. 3 having a bore 250A in which oil 232 from the hydraulic chamber 230 enters. The upstream end of the isolation valve has a hole 252 which corresponds to the shear pin 248. The downstream end of the isolation valve 250 ends with a flat face 254, which blocks the bore 250A from communicating with a chamber (not shown) further downstream in the setting tool. Various o-rings 256 and 258 are distributed on the outside of the isolation valve 250 for preventing a fluid from moving along an interface between the isolation valve and the body 242 and/or the insert 244.

FIG. 3 shows the isolation valve 250 having plural ports 260-1 to 260-4 that fluidly communicate with the internal bore 250A. Although FIG. 3 shows only four ports, it is possible to have more or less ports. Returning to FIG. 2, it is noted that the ports 260-1 to 260-4 are not aligned with any corresponding ports in the body 242. In this regard, FIG. 2 shows a port 262 formed in the body 242 that extends substantially perpendicular to the body and all the way to the exterior of the setting tool. This will be used, as discussed later, to allow the pressured burnt gases from the pressure chamber 206 to exit the setting tool after the wellbore tool is set. Port 262 may be opened to the exterior of the setting tool or it may be closed by a rupture disc 264. The rupture disc 264 is selected to break at a given pressure, which is calculated to correspond to a pressure of the burnt gas that sets the wellbore tool.

FIG. 2 also shows that when the isolation valve 250 is in the open position, the oil 232 from the hydraulic chamber 230 can freely pass the isolation valve 250, toward a working chamber 270 formed in the setting tool, past the isolation valve. FIG. 2 shows that the oil 232 enters the bore 250A and then further flows through ports 260-2 and 260-3 into the working chamber 270. Further, FIG. 2 shows that the oil 232 can also enter through slots 266 into the bore 246 of the insert 244, and move along a passage 268 to the ports 260-1 and 260-4, then into bore 250A and further into the working chamber 270 through ports 260-2 and 260-3.

Figure 4:
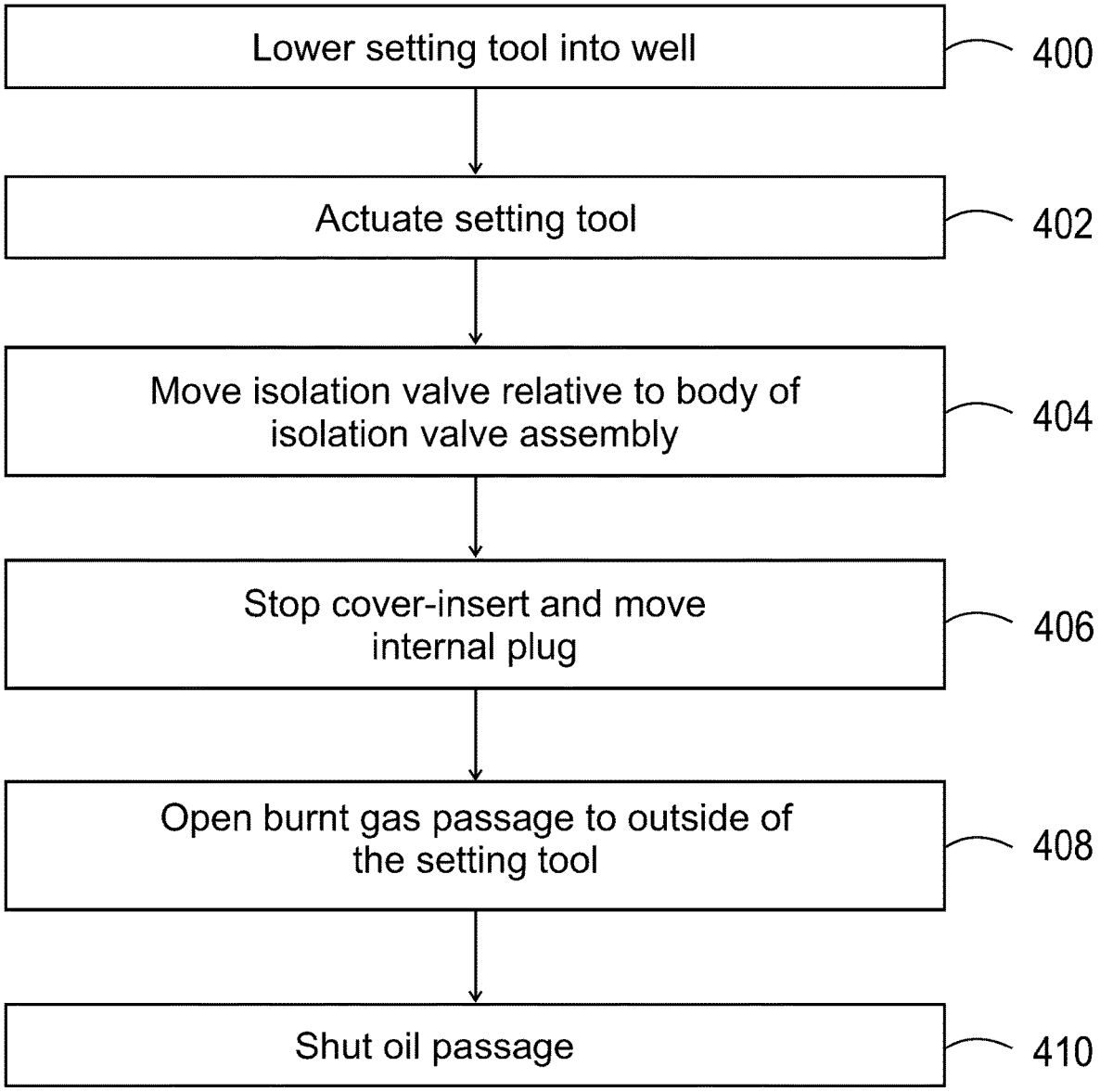
FIG. 4 is a flowchart of a method for automatically bleeding off a setting tool into a well.
Figure 5:
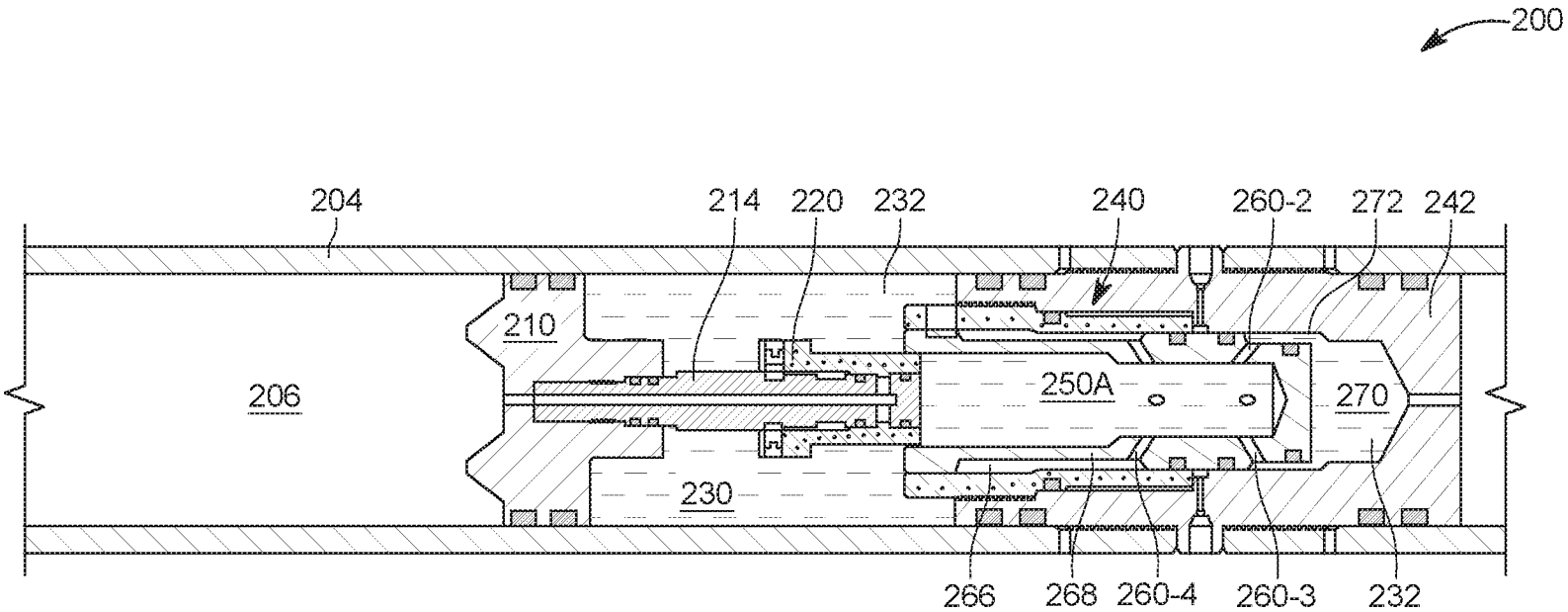
FIG. 5 illustrates a floating piston that is actuated to bleed off the setting tool.

A method for using the setting tool 200 discussed with regard to FIGS. 2 and 3 is now discussed with regard to FIG. 4. In step 400, the setting tool 200 and a wellbore tool 280 (see FIG. 2), which may be a plug or a toe valve, are lowered into the well. In step 402, the setting tool is actuated, for example, by igniting a power charge stored in the pressure chamber 206. Other actuating mechanisms 282 (e.g., hydraulic, electric) may be used for actuating the floating piston 210. The pressure of the burnt gases in the pressure chamber 206 makes the floating piston 210 to move toward the isolation valve assembly 240. Piston 210 moves together with the internal plug 214 and the cover-insert member 220, as illustrated in FIG. 5. FIG. 5 shows the oil 232 moving from the hydraulic chamber 230 into the working chamber 270 mainly through bore 250A and ports 260-2 and 260-3. FIG. 5 also shows that the oil 232 further enters the working chamber 270 along a passage 272 formed at the downstream end of the isolation valve 250, between the outside surface of the isolation valve and the inner surface of the body 242.

As the floating piston 210 continues to move toward the isolation valve assembly 240, the cover-insert member 220 starts to enter inside bore 250A. The outside surface of the cover-insert member 220, at the downstream end, is manufactured to fit the inside surface of the bore 250A, so that oil cannot pass at the interface between the cover-insert member 220 and the bore 250A. In this regard, FIG. 5 shows how the downstream end of the cover-insert member 220 has already entered bore 250A, which means that the direct oil path from the hydraulic chamber 230 to the bore 250A is closed at this time. The only oil path that is left open is through slots 266, passage 268, ports 260-1 to 260-4 and passage 272.

Figure 6:
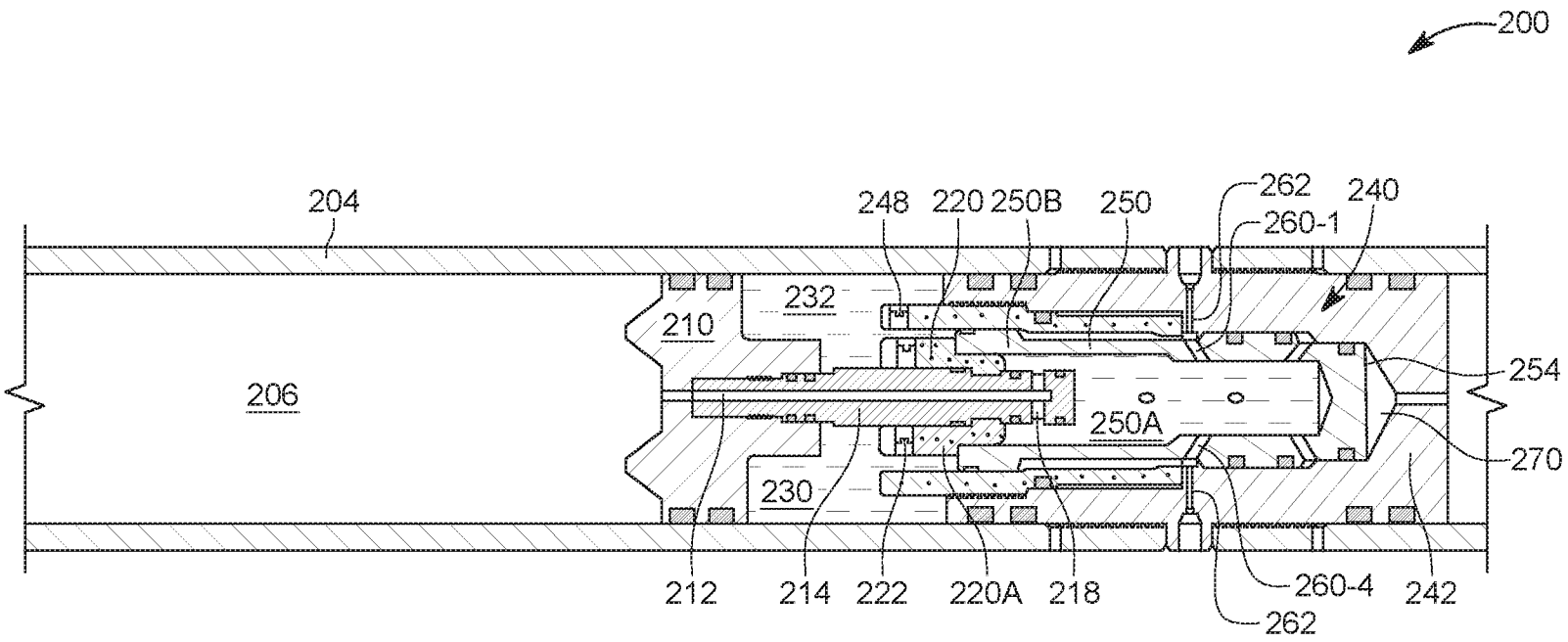
FIG. 6 illustrates the path along which the pressurized gas is removed from the setting tool into the well.

The cover-insert member 220 continues to enter inside bore 250A until a shoulder 220A of the member 220 contacts a corresponding shoulder 250B of the isolation valve 250, as illustrated in FIG. 6. At this point, although piston 210 is still moving in a downstream direction, the cover-insert member 220 cannot further advance inside the bore 250A. Due to the force exerted by the cover-insert member 220 on the isolation valve 250, the shear pin 248 breaks away and frees the isolation valve 250. Note that the shear pin 248 is designed to break before the shear pin 222. For example, in one embodiment, the shear pins 222 and 248 are identical, but only one shear pin 248 is used with the isolation valve 250 and two shear pins 222 are used with the internal plug 214. In another embodiment, one shear pin 222 and one shear pin 248 may be used, but the shear pin 222 is manufactured to be stronger than the shear pin 248, so that the shear pin 248 breaks before shear pin 222. As a consequence, the isolation valve 250 moves in step 404, together with the cover-insert member 220 and the piston 210, downstream. Note that the movement of the piston 210 downstream continues until the force exerted by the burnt gas in pressure chamber 206 is equalized by a counter force. This counter force appears when the flat face 254 of the isolation valve 250 contacts the body 242 of the isolation valve assembly 240. Note that the body 242 is connected to the housing 204 of the setting tool 200 through threads. Thus, when the isolation valve 250 touches with its flat face 254 the body 242, the isolation valve 250 stops its movement. This results in the cover-insert member 220 being forced to stop its movement in step 406 while the piston 210 and the internal plug 214 continue to further move so that the port 218 of the internal plug 214 is freed from the cover-insert member 220 as shown in FIG. 6. Because of the force exerted by piston 210 on the internal plug 214, and because the cover-insert member 220 has stopped, the shear pins 222 that kept these two elements mechanically connected to each other shears, so that the cover-insert member 220 remains at rest while the internal plug 214 continues its movement.

As further illustrated in FIG. 6, the path 212 for the burnt gas from the pressure chamber 206 is opened in step 408 through the port 218 into the bore 250A. However, due to the stoppage of the isolation valve 250, the ports 260-1 and 260-4 are aligned now with ports 262, and the burnt gas is released outside the setting tool, inside the casing. Thus, the goal of auto-bleeding the setting tool, without human intervention is achieved. Further, the auto-bleeding is achieved underground, in the casing, away from any human, which makes this process very safe. Furthermore, the oil's path between the working chamber 270 and the hydraulic chamber 230 is shut in step 410 by the isolation valve 250, so that no oil is released into the casing and also the oil does not mix with the burnt gases.

Figure 7:
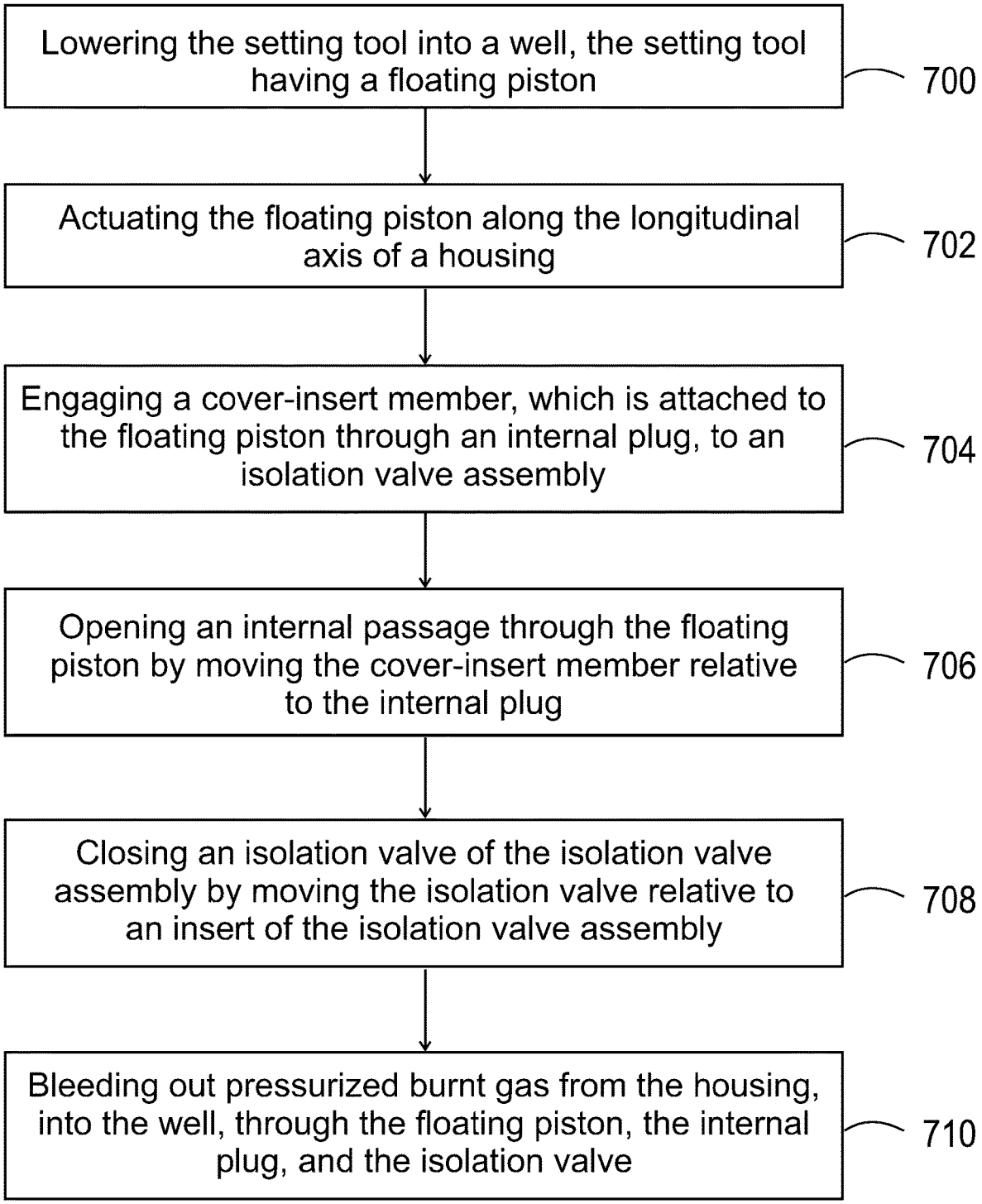
FIG. 7 is a flowchart of a method for actuating the setting tool.

Another method for automatically bleeding off a setting tool 200 is now discussed with regard to FIG. 7. The method includes a step 700 of lowering the setting tool 200 into a well, the setting tool 200 having a floating piston, a step 702 of actuating the floating piston 210 along a longitudinal axis of a housing 202, a step 704 of engaging a cover-insert member 220, which is attached to the floating piston 210 through an internal plug 214, to an isolation valve assembly, a step 706 of opening an internal passage 211 through the floating piston 210 by moving the cover-insert member 220 relative to the internal plug, a step 708 of closing an isolation valve 250 of the isolation valve assembly 240 by moving the isolation valve 250 relative to an insert 244 of the isolation valve assembly, and a step 710 of bleeding out pressurized burnt gas from the housing, into the well, through the floating piston 210, the internal plug 214, and the isolation valve.

In one embodiment, the step of opening may include breaking a first shear pin between the cover-insert member and the internal plug. The step of opening may further include uncovering a port formed between an exterior of the internal plug and the internal passage formed along the internal plug. The step of breaking may include breaking a second shear pin located between the isolation valve and the insert and may also include aligning plural ports of the isolation valve with a port of a body of the isolation valve assembly so that the pressurized burnt gas exits the setting tool.

In another embodiment, the pressurized burnt gas is formed after burning a power charge inside the housing. The pressurized burnt gas travels along a path that extends through the floating piston, the internal plug, a hydraulic chamber defined by the floating piston and the isolation valve assembly, a bore of the isolation valve, the plural ports of the isolation valve, and the port of the body of the isolation valve assembly. In one application, the internal plug has an internal passage that fluidly communicates (1) with an internal passage through the floating piston, at one end, and (2) with a port at the other end, and wherein the port is covered by the cover-insert member. The isolation valve assembly includes a body having a bore, an insert fixedly attached to an inside of the bore of the body, and the isolation valve located inside a bore of the insert.

The disclosed embodiments provide methods and systems for automatically bleeding off a pressurized gas from a setting tool while located in a well. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A setting tool for setting an auxiliary tool in a well, the setting tool comprising:

a housing having a floating piston, the floating piston separating the housing into (a) a pressure chamber, located upstream the floating piston, and (b) a hydraulic chamber, located downstream the floating piston;

an internal plug having an upstream end that terminates within the floating piston and having a downstream end extending into the hydraulic chamber; and a cover-insert member covering the downstream end of the internal plug, wherein the internal plug has an internal passage that fluidly communicates, (1) at one end, with an internal passage extending through the floating piston, and (2) at another end, with a port, and wherein the port is covered by the cover-insert member.

2. The setting tool of claim 1, further comprising:

a first shear pin configured to mechanically attach the cover-insert member to the internal plug.

3. The setting tool of claim 2, further comprising:

an isolation valve assembly which separates the hydraulic chamber from a working chamber, also located inside the housing.

4. The setting tool of claim 3, wherein the isolation valve assembly comprises:

a body having a bore;

an insert fixedly attached to an inside of the bore of the body; and an isolation valve located inside a bore of the insert.

5. The setting tool of claim 4, further comprising:

a second shear pin that attaches the insert to the isolation valve.

6. The setting tool of claim 5, wherein the first shear pin is stronger than the second shear pin.

7. The setting tool of claim 5, wherein the first shear pin includes two pins and the second shear pin includes a single pin.

8. The setting tool of claim 4, wherein the isolation valve comprises:

plural slots located at an upstream end to allow a fluid from the hydraulic chamber to flow into a passage formed between the insert and the isolation valve.

9. The setting tool of claim 8, wherein the isolation valve comprises:

plural ports located at a downstream end and in fluid communication with the passage so that the fluid from the hydraulic chamber flows into a bore of the isolation valve, through the plural ports and the passage.

10. The setting tool of claim 9, wherein the bore of the isolation valve directly communicates with the hydraulic chamber.

11. The setting tool of claim 9, wherein the body of the isolation valve assembly has a port that achieves fluid communication between an outside of the body and the bore of the body.

12. The setting tool of claim 10, wherein burnt gas under pressure from the pressure chamber is automatically released through the port of the body of the isolation valve assembly, outside the housing, after the first shear pin that mechanically attaches the cover-insert member to the internal plug is broken and after a second shear pin that attaches the insert to the isolation valve is also broken.

13. The setting tool of claim 11, wherein the plural ports of the isolation valve are misaligned with the port of the body of the isolation valve assembly while the isolation valve is open.

14. The setting tool of claim 13, wherein a subset of the plural ports of the isolation valve are aligned with the port of the body of the isolation valve assembly when the isolation valve is closed.

15. The setting tool of claim 9, wherein a subset of the plural ports of the isolation valve fluidly communicate with the working chamber while the isolation valve is open.

16. The setting tool of claim 9, wherein none of the plural ports of the isolation valve fluidly communicate with the working chamber while the isolation valve is closed.

17. An automatically bleeding off setting tool comprising:

a housing;

a floating piston located inside the housing;

an internal plug having an upstream end located inside the floating piston and having a downstream end extending outside the floating piston; and a cover-insert member covering the downstream end of the internal plug, wherein the internal plug has (a) an internal passage that extends only partially along the internal plug and (b) a port that fluidly communicates with the internal passage, but the port is closed by the cover-insert member.

18. The setting tool of claim 17, further comprising:

a first shear pin configured to mechanically attach the cover-insert member to the internal plug.

19. The setting tool of claim 18, further comprising:

an isolation valve assembly which separates a hydraulic chamber of the housing from a working chamber, also located inside the housing.

20. The setting tool of claim 19, wherein the isolation valve assembly comprises:

a body having a bore;

an insert fixedly attached to an inside of the bore of the body; and an isolation valve located inside a bore of the insert.

21. The setting tool of claim 20, further comprising:

a second shear pin that attaches the insert to the isolation valve.

22. The setting tool of claim 21, wherein the first shear pin is stronger than the second shear pin.

23. The setting tool of claim 21, wherein the first shear pin includes two pins and the second shear pin includes a single pin.

24. The setting tool of claim 23, wherein the isolation valve comprises:

plural slots located at an upstream end to allow a fluid from the hydraulic chamber to flow into a passage formed between the insert and the isolation valve.

25. The setting tool of claim 24, wherein the isolation valve comprises:

plural ports located at a downstream end and in fluid communication with the passage so that the fluid from the hydraulic chamber flows into a bore of the isolation valve.

26. The setting tool of claim 25, wherein the bore of the isolation valve directly communicates with the hydraulic chamber.

27. The setting tool of claim 26, wherein the body of the isolation valve assembly has a port that achieves fluid communication between an outside of the body and the bore of the body.

28. The setting tool of claim 27, wherein a burnt gas under pressure from a pressure chamber located in the housing is automatically released through the port of the body of the isolation valve assembly, outside the housing, after the first shear pin and the second shear pin are broken.

29. The setting tool of claim 28, wherein the plural ports of the isolation valve are misaligned with the port of the body of the isolation valve assembly while the isolation valve is open.

30. The setting tool of claim 29, wherein a subset of the plural ports of the isolation valve are aligned with the port of the body of the isolation valve assembly when the isolation valve is closed.

31. The setting tool of claim 25, wherein a subset of the plural ports of the isolation valve fluidly communicate with the working chamber while the isolation valve is open.

32. The setting tool of claim 25, wherein none of the plural ports of the isolation valve fluidly communicate with the working chamber while the isolation valve is closed.

33. A method for automatically bleeding off a setting tool, the method comprising:

lowering the setting tool into a well, the setting tool having a housing that hosts a floating piston, the floating piston separating the housing into (a) a pressure chamber, located upstream the floating piston, and (b) a hydraulic chamber, located downstream the floating piston;

actuating the floating piston along a longitudinal axis of the housing of the setting tool;

engaging a cover-insert member, which is attached to the floating piston through an internal plug, to an isolation valve assembly, wherein the internal plug has an upstream end that terminates within the floating piston and has a downstream end extending into the hydraulic chamber, and the cover-insert member covers the downstream end of the internal plug;

opening an internal passage through the floating piston by moving the cover-insert member relative to the internal plug;

closing an isolation valve of the isolation valve assembly by moving the isolation valve relative to an insert of the isolation valve assembly; and bleeding out pressurized burnt gas from the housing, into the well, through the floating piston, the internal plug, and the isolation valve, wherein the internal plug has an internal passage that fluidly communicates, (1) at one end, with the internal passage of the floating piston, which extends through the floating piston, and (2) at another end, with a port, and wherein the port is covered by the cover-insert member prior to the step of bleeding out.

34. The method of claim 33, wherein the step of opening comprises:

breaking a first shear pin between the cover-insert member and the internal plug.

35. The method of claim 34, wherein the step of opening further comprises:

uncovering the port formed between an exterior of the internal plug and the internal passage formed along the internal plug.

36. The method of claim 34, wherein the step of closing comprises:

breaking a second shear pin between the isolation valve and the insert, wherein the second shear pin is stronger than the first shear pin.

37. The method of claim 36, wherein the step of closing further comprising:

aligning plural ports of the isolation valve with a port of a body of the isolation valve assembly so that the pressurized burnt gas exits the setting tool.

38. The method of claim 37, wherein the pressurized burnt gas is formed after burning a power charge inside the housing.

39. The method of claim 38, wherein the pressurized burnt gas travels along a path that extends through the floating piston, the internal plug, a hydraulic chamber defined by the floating piston and the isolation valve assembly, a bore of the isolation valve, the plural ports of the isolation valve, and the port of the body of the isolation valve assembly.

40. The method of claim 33, wherein the isolation valve assembly includes a body having a bore, the insert fixedly attached to an inside of the bore of the body, and the isolation valve located inside a bore of the insert.

* * * * *